US009273622B2

(12) United States Patent
Glugla

(10) Patent No.: US 9,273,622 B2
(45) Date of Patent: Mar. 1, 2016

(54) METHODS AND SYSTEMS FOR PRE-IGNITION CONTROL IN A VARIABLE DISPLACEMENT ENGINE

(71) Applicant: Ford Global Technologies, LLC, Dearborn, MI (US)

(72) Inventor: Chris Paul Glugla, Macomb, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 193 days.

(21) Appl. No.: 14/201,296

(22) Filed: Mar. 7, 2014

(65) Prior Publication Data

US 2015/0252743 A1 Sep. 10, 2015

(51) Int. Cl.

| | |
|---|---|
| ***F02D 17/02*** | (2006.01) |
| ***F02D 41/00*** | (2006.01) |
| ***F02D 41/14*** | (2006.01) |
| *F02D 41/24* | (2006.01) |
| *F02D 35/02* | (2006.01) |

(52) U.S. Cl.

CPC ..... *F02D 41/0087* (2013.01); *F02D 17/02* (2013.01); *F02D 41/1498* (2013.01); *F02D 35/027* (2013.01); *F02D 41/1475* (2013.01); *F02D 41/2451* (2013.01); *F02D 41/2454* (2013.01); *F02D 2250/14* (2013.01)

(58) Field of Classification Search

CPC . F02D 41/0087; F02D 41/1498; F02D 17/02; F02D 35/025; F02D 35/027; F02D 2200/021; F02D 2200/1002

USPC ..... 123/198 F, 481, 435, 436; 701/103, 110, 701/111; 73/114.11

See application file for complete search history.

(56) References Cited

U.S. PATENT DOCUMENTS

| | | | | |
|---|---|---|---|---|
| 5,896,842 | A | 4/1999 | Abusamra | |
| 8,073,613 | B2 * | 12/2011 | Rollinger | F01L 1/34 123/435 |
| 8,447,502 | B2 | 5/2013 | Rollinger et al. | |
| 2012/0285161 | A1 | 11/2012 | Kerns et al. | |
| 2013/0047956 | A1 | 2/2013 | Davis | |

* cited by examiner

*Primary Examiner* — Hai Huynh

(74) *Attorney, Agent, or Firm* — Julia Voutryas; Alleman Hall McCoy Russell & Tuttle LLP

(57) ABSTRACT

Methods and systems are provided for reducing pre-ignition incidence in a variable displacement engine during reactivation from a VDE mode. During conditions when one or more deactivated cylinders are reactivated to elevated engine loads, the reactivated cylinder(s) may be temporarily and preemptively enriched to reduce the possibility of cylinder pre-ignition. The preemptive enrichment is learned and further adjusted in a closed loop fashion.

20 Claims, 8 Drawing Sheets

METHODS AND SYSTEMS FOR PRE-IGNITION CONTROL IN A VARIABLE DISPLACEMENT ENGINE

FIELD

The present application relates to methods and systems for controlling pre-ignition in a variable displacement engine (VDE).

BACKGROUND AND SUMMARY

Engines may be configured to operate with a variable number of active or deactivated cylinders to increase fuel economy, while optionally maintaining the overall exhaust mixture air-fuel ratio about stoichiometry. Such engines are known as variable displacement engines (VDE). In some examples, a portion of an engine's cylinders may be disabled during selected conditions, where the selected conditions can be defined by parameters such as a speed/load window, as well as various other operating conditions including vehicle speed. A VDE control system may disable selected cylinders through the control of a plurality of cylinder valve deactivators that affect the operation of the cylinder's intake and exhaust valves, or through the control of a plurality of selectively deactivatable fuel injectors that affect cylinder fueling. By reducing displacement under low torque request situations, the engine is operated at a higher manifold pressure, reducing engine friction due to pumping, and resulting in reduced fuel consumption.

As such, abnormal combustion events, such as those due to pre-ignition can occur in a VDE engine. One example approach for addressing pre-ignition events occurring in a VDE engine system is shown by Kerns et al. in US 20120285161. Therein, a threshold and window for pre-ignition detection is adjusted during a VDE mode of operation based on a number of deactivated cylinders. The threshold is also varied between VDE and non-VDE modes to better compensate for background noise differences, thereby improving pre-ignition detection during VDE and non-VDE modes.

However, the inventors herein have identified potential issues with such an approach. As an example, during selected cylinder reactivations, pre-ignition may be induced. Thus, even if the pre-ignition is detected accurately in the VDE mode and addressed, pre-ignition may continue to occur when the engine is transitioned to the non-VDE mode. In other words, during selected conditions, such as when operating with one or more cylinders deactivated for a significant amount of time, a likelihood of abnormal combustion, such as due to cylinder pre-ignition, may increase. This is due to the accumulation of oil in the deactivated engine cylinders. For example, during long steady-state highway cruising conditions, the deactivated cylinders may collect a fair amount of oil because of vacuum created in the deactivated engine cylinders due to continued engine spinning. Oil may also be drawn in due to lower temperatures in the cylinder during deactivation operation, as well as lower pressures on the oil control ring of the piston. As such, the lower temperatures and pressures allow oil to migrate into the combustion chamber, and collect therein. The trapped oil can then act as an ignition source during subsequent cylinder reactivation. In some engine systems, control strategies may be applied to cylinders after extended operation in deactivation mode to help restore pressure on the oil control rings. However, in a boosted engine, if one or more cylinders are deactivated for an extended period, and this is followed by a significant increase in torque demand (such as during a passing maneuver) where boost is maintained or increased and the cylinders are reactivated, the oil trapped in the cylinder(s) may become an ignition source leading to pre-ignition events, poor NVH (audible knocking) and potential engine damage. In particular, the combustion of the trapped oil may cause high in-cylinder pressures and temperatures associated with pre-ignition that can degrade engine components as well as decrease engine efficiency.

In one example, some of the above issues may be at least partly addressed by a method for an engine comprising: while reactivating a cylinder to a higher than threshold load condition, and before an indication of pre-ignition in the cylinder is received, enriching the reactivated cylinder, the enrichment adjusted based on each of cylinder load and a preceding duration of cylinder deactivation. In this way, pre-ignition occurring during cylinder reactivation to high loads following prolonged cylinder deactivation may be reduced.

For example, an engine may be configured with selectively deactivatable cylinder fuel injectors and/or valves. During conditions of low torque demand, one or more engine cylinders may be selectively deactivated and the torque demand may be met via the remaining active cylinders. In response to a subsequent increase in operator torque demand, the cylinders may be reactivated. As such, due to engine operation during the deactivation of the selected cylinders, oil may accumulate in the deactivated cylinders, which may ignite if the cylinder load is too high. Therefore, if the increase in operator torque demand is substantially high, and the cylinder load of the reactivated cylinders exceeds a threshold, the reactivated cylinders may be operated richer than stoichiometry for a duration to mitigate potential pre-ignition caused by combustion of the accumulated oil. Herein, the enrichment may be performed preemptively, before an actual indication of pre-ignition is received. A degree of cylinder enrichment may be adjusted based on the duration for which the cylinder was previously deactivated as well as the load in the cylinder upon reactivation. As such, more oil may accumulate in the deactivated cylinder as the duration increases. Likewise, the propensity for cylinder pre-ignition may increase as the cylinder load upon reactivation increases. Thus, a degree of richness and a number of enrichment cycles may be increased as the duration of deactivation and the cylinder load increases. If no pre-ignition occurs during the reactivation, on a subsequent reactivation to high load, an enrichment of the given cylinder may be trimmed. Alternatively, if pre-ignition does occur during the reactivation, on a subsequent reactivation to high load, an enrichment of the given cylinder may be increased. As such, the pre-emptive enrichment may not be performed in cylinders that were deactivated as part of an engine shut-down operation, such as during an idle-stop operation or a deceleration fuel shut-off operation since significant oil accumulation does not occur during such deactivations.

In this way, pre-ignition propensity in a cylinder being reactivated to high loads from a deactivated condition can be reduced. By preemptively enriching a cylinder that was selectively deactivated while the engine continued to spin, pre-ignition resulting from the combustion of oil that accumulated in the cylinder during the deactivation can be better anticipated and addressed. In addition, the enrichment provides cylinder cooling which further reduces pre-ignition events in the cylinder during reactivation to high loads. By adjusting the enrichment in a closed-loop fashion based on the occurrence of pre-ignition events during the reactivation, the enrichment can be optimized, reducing fuel wastage and emissions output. Overall, cylinder pre-ignition can be better addressed in a variable displacement engine during reactivation to high loads.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 3:
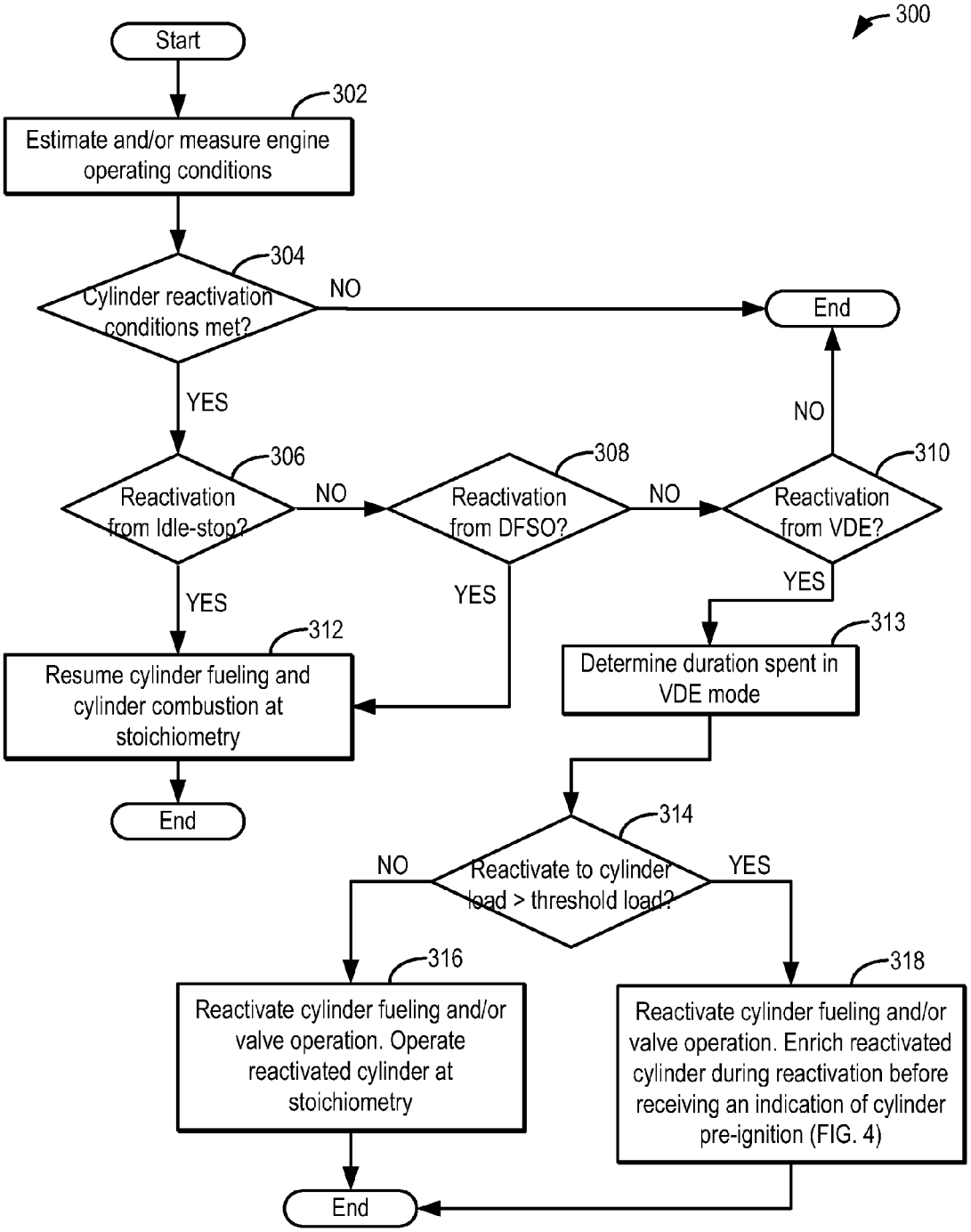
FIG. 3 shows a high level flow chart for adjusting cylinder fueling during reactivation of a deactivated engine cylinder.
Figure 4:
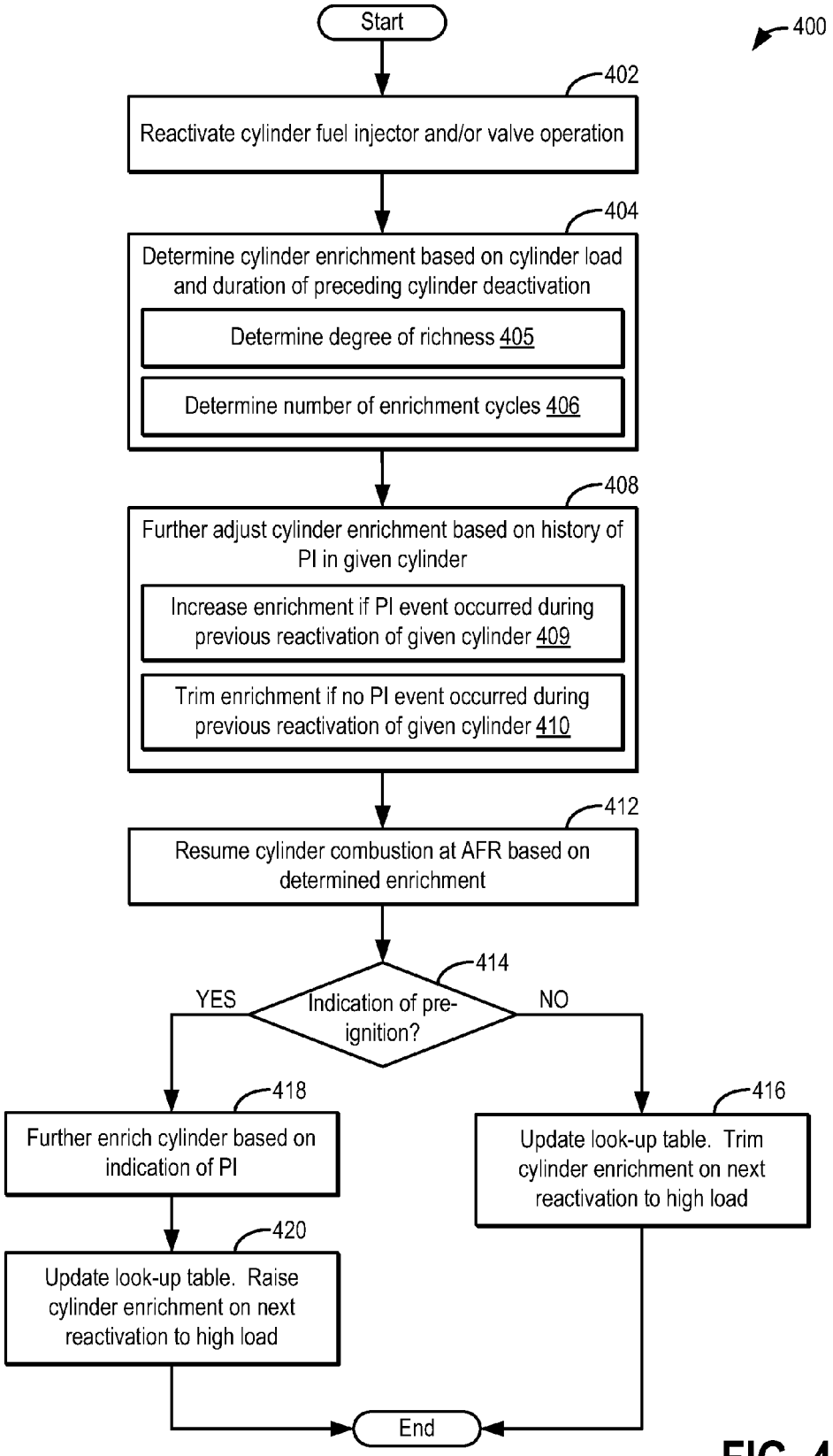
FIG. 4 shows a high level flow chart for enriching a cylinder of a variable displacement engine during reactivation to high load conditions.
Figure 6:
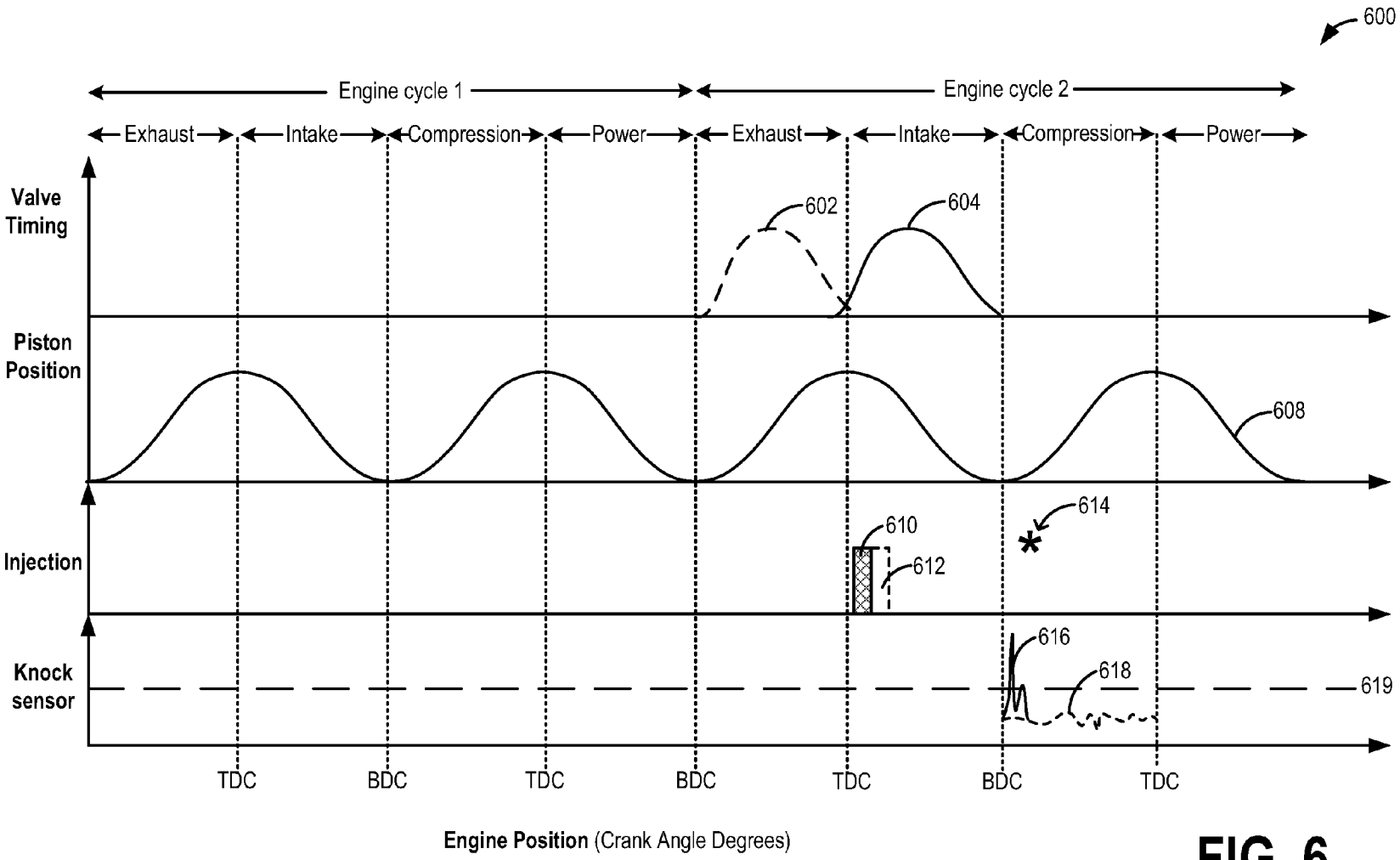
FIG. 6 shows an example timing of pre-ignition mitigating cylinder enrichment performed in a given engine cylinder in relation to the strokes of an engine cycle.
Figure 7:
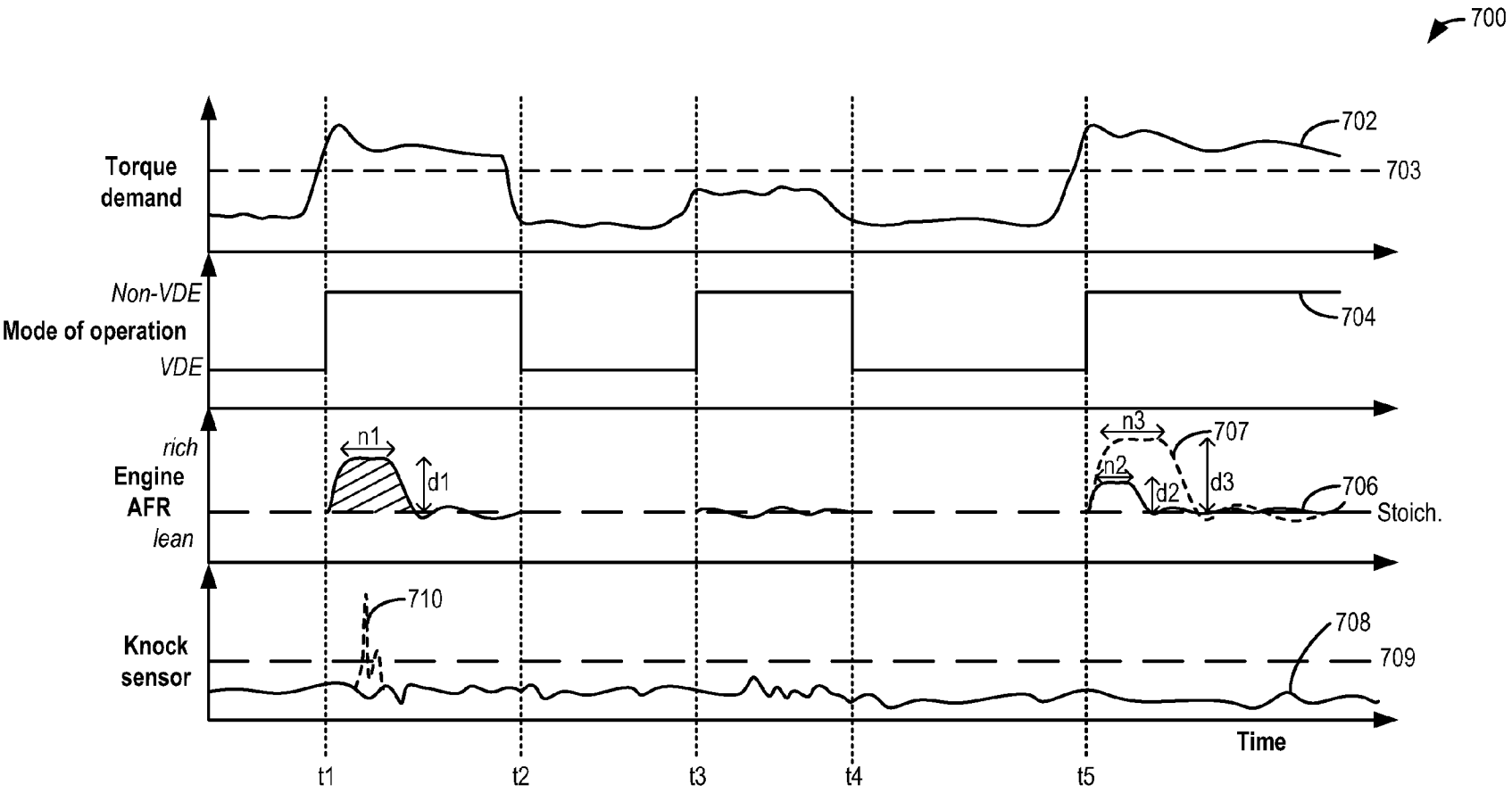
FIGS. 7-8 show example pre-ignition mitigating enrichments performed during cylinder reactivations to high load conditions, according to the present disclosure.
Figure 8:
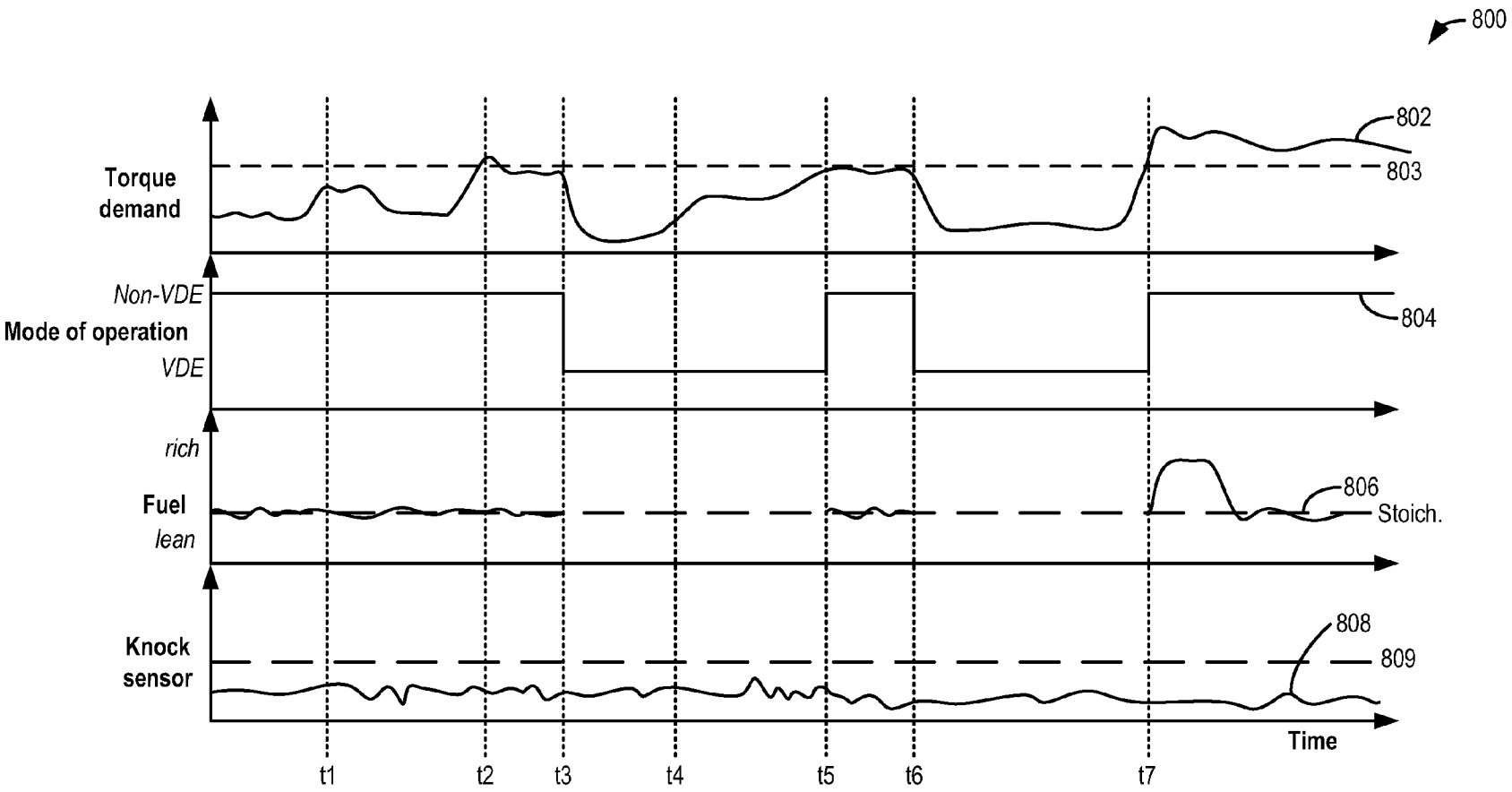

Methods and systems are provided for reducing an incidence of pre-ignition in a variable displacement engine system (such as the engine system of FIGS. 1-2) during cylinder reactivation to high load conditions. When transitioning from a VDE mode to a non-VDE mode, fueling of a reactivated engine cylinder may be adjusted so as to preemptively address potential pre-ignition events. An engine controller may perform a control routine, such as the routine of FIGS. 3 and 5, to enrich a cylinder when it is reactivated to higher than threshold loads. As shown at FIG. 4, the enrichment may be adjusted based on parameters that affect the amount of oil that may have accumulated in the cylinder during the preceding deactivation. The enrichment may be further adjusted in a closed-loop fashion based on pre-ignition incidences during the reactivation. Example enrichments during cylinder reactivation from a VDE mode are shown at FIGS. 6-8. In this way, pre-ignition may be better anticipated and addressed.

Figure 1:
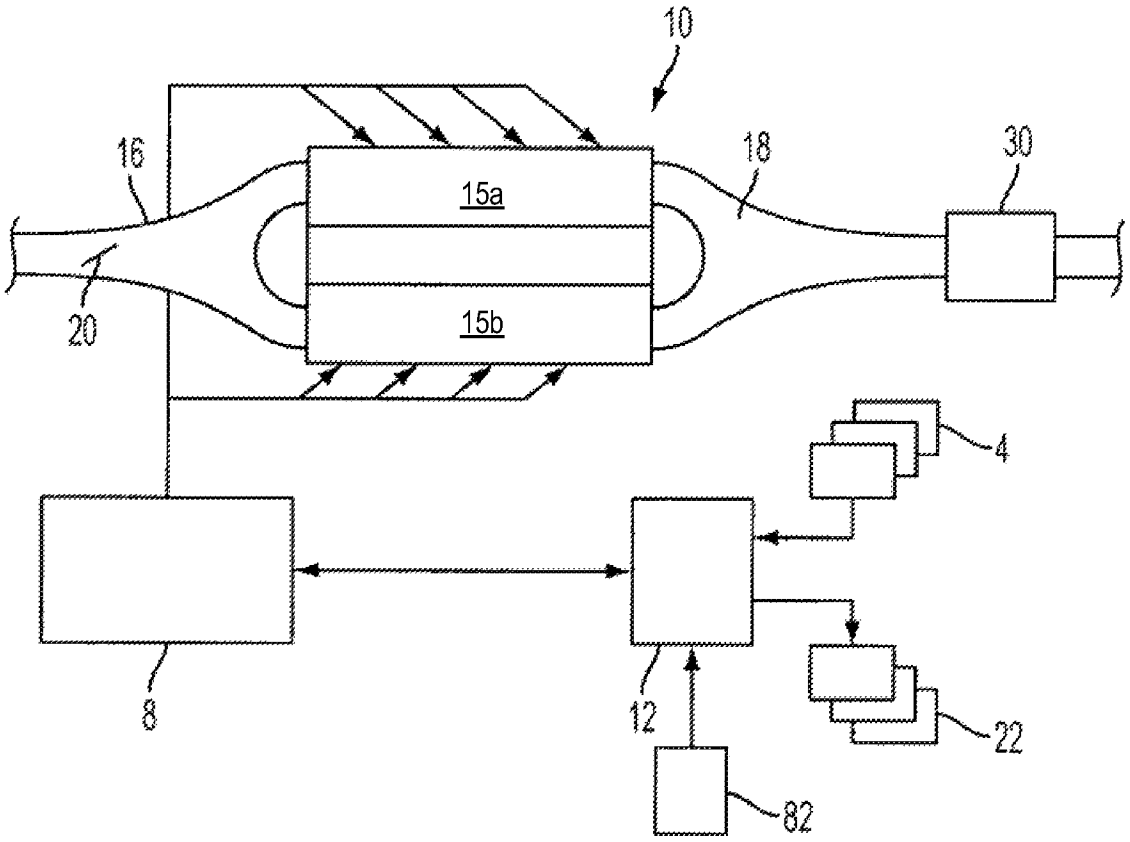
FIG. 1 schematically shows an example variable displacement engine system.

FIG. 1 shows an example variable displacement engine (VDE) 10 having a first bank 15*a* and a second bank 15*b*. In the depicted example, engine 10 is a V8 engine with the first and second banks each having four cylinders. However, in alternate embodiments, the engine may have a different number of engine cylinders, such as 6, 10, 12, etc. Engine 10 has an intake manifold 16, with throttle 20, and an exhaust manifold 18 coupled to an emission control system 30. Emission control system 30 includes one or more catalysts and air-fuel ratio sensors, such as described with regard to FIG. 2. As one non-limiting example, engine 10 can be included as part of a propulsion system for a passenger vehicle.

During selected conditions, such as when the full torque capability of the engine is not needed, one or more cylinders, such as one of a first or second cylinder group, may be selected for deactivation (herein also referred to as a VDE mode of operation). Specifically, one or more cylinders of the selected group of cylinders may be deactivated by shutting off respective fuel injectors while maintaining operation of the intake and exhaust valves such that air may continue to be pumped through the cylinders. While fuel injectors of the disabled cylinders are turned off, the remaining enabled cylinders continue to carry out combustion with fuel injectors active and operating. To meet the torque requirements, the engine produces the same amount of torque on those cylinders for which the injectors remain enabled. This requires higher manifold pressures, resulting in lowered pumping losses and increased engine efficiency. Also, the lower effective surface area (from only the enabled cylinders) exposed to combustion reduces engine heat losses, improving the thermal efficiency of the engine. In alternate examples, engine system 10 may have cylinders with selectively deactivatable intake and/or exhaust valves wherein deactivating the cylinder includes deactivating the intake and/or exhaust valves.

Cylinders may be grouped for deactivation in a bank-specific manner. For example, in FIG. 1, the first group of cylinders may include the four cylinders of the first bank 15*a* while the second group of cylinders may include the four cylinders of the second bank 15*b*. In an alternate example, instead of one or more cylinders from each bank being deactivated together, two cylinders from each bank of the V8 engine may be selectively deactivated together.

Engine 10 may operate on a plurality of substances, which may be delivered via fuel system 8. Engine 10 may be controlled at least partially by a control system including controller 12. Controller 12 may receive various signals from sensors 4 coupled to engine 10, and send control signals to various actuators 22 coupled to the engine and/or vehicle.

Fuel system 8 may be further coupled to a fuel vapor recovery system (not shown) including one or more canisters for storing refueling and diurnal fuel vapors. During selected conditions, one or more valves of the fuel vapor recovery system may be adjusted to purge the stored fuel vapors to the engine intake manifold to improve fuel economy and reduce exhaust emissions. In one example, the purge vapors may be directed near the intake valve of specific cylinders. For example, during a VDE mode of operation, purge vapors may be directed only to the cylinders that are firing. This may be achieved in engines configured with distinct intake manifolds for distinct groups of cylinders. Alternatively, one or more vapor management valves may be controlled to determine which cylinder gets the purge vapors.

Controller 12 may receive an indication of cylinder knock or pre-ignition from one or more knock sensors 82 distributed along the engine block. When included, the plurality of knock sensors may be distributed symmetrically or asymmetrically along the engine block. As such, the one or more knock sensors 82 may be accelerometers, or ionization sensors. Further details of the engine 10 and an example cylinder are described with regard to FIG. 2.

Figure 2:
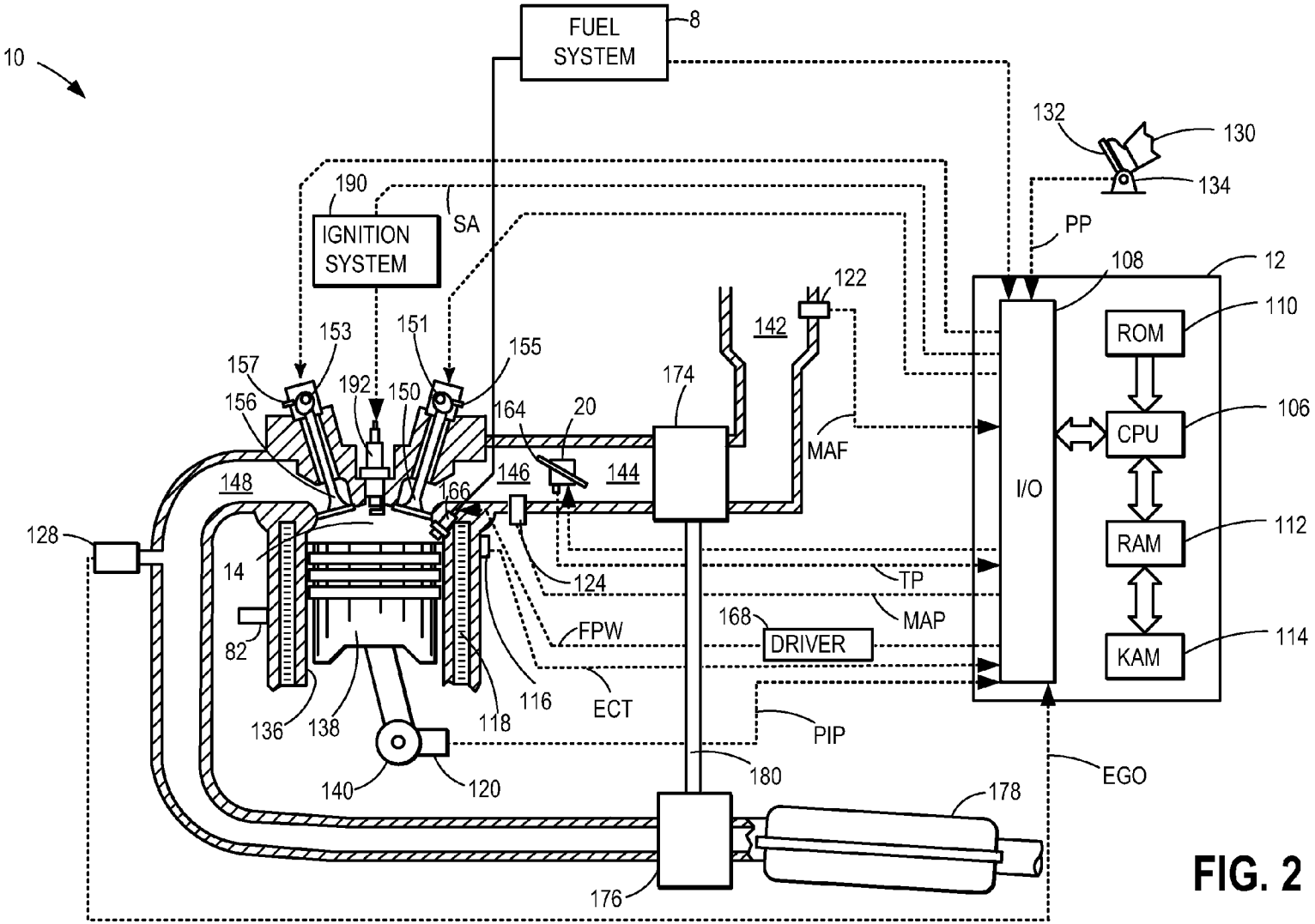
FIG. 2 shows a partial engine view.

FIG. 2 depicts an example embodiment of a combustion chamber or cylinder of internal combustion engine 10. Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some embodiments, one or more of the intake passages may include a boosting device such as a turbocharger or a supercharger. For example, FIG. 2 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 20 including a throttle plate 164 may be provided along an intake passage of the engine for varying the flow rate and/or pressure of intake air provided to the engine cylinders. For example, throttle 20 may be disposed downstream of compressor 174 as shown in FIG. 2, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Exhaust temperature may be estimated by one or more temperature sensors (not shown) located in exhaust passage 148. Alternatively, exhaust temperature may be inferred based on engine operating conditions such as speed, load, air-fuel ratio (AFR), spark retard, etc. Further, exhaust temperature may be computed by one or more exhaust gas sensors 128. It may be appreciated that the exhaust gas temperature may alternatively be estimated by any combination of temperature estimation methods listed herein.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT, as shown in FIG. 1), variable valve timing (VVT) and/or variable valve lift (VVL) systems that may be operated by controller 12 to vary valve operation. The position of intake valve 150 and exhaust valve 156 may be determined by valve position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. Conventionally, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some embodiments, each cylinder of engine 10 may be configured with one or more fuel injectors for providing fuel thereto. As a non-limiting example, cylinder 14 is shown including one fuel injector 166. Fuel injector 166 is shown coupled directly to cylinder 14 for injecting fuel directly therein in proportion to the pulse width of signal FPW received from controller 12 via electronic driver 168. In this manner, fuel injector 166 provides what is known as direct injection (hereafter also referred to as "DI") of fuel into combustion cylinder 14. While FIG. 1 shows injector 166 as a side injector, it may also be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a high pressure fuel system 8 including fuel tanks, fuel pumps, and a fuel rail. Alternatively, fuel may be delivered by a single stage fuel pump at lower pressure, in which case the timing of the direct fuel injection may be more limited during the compression stroke than if a high pressure fuel system is used. Further, while not shown, the fuel tanks may have a pressure transducer providing a signal to controller 12. It will be appreciated that, in an alternate embodiment, injector 166 may be a port injector providing fuel into the intake port upstream of cylinder 14.

It will also be appreciated that while the depicted embodiment illustrates the engine being operated by injecting fuel via a single direct injector; in alternate embodiments, the engine may be operated by using two or more injectors (for example, a direct injector and a port injector, two direct injectors, or two port injectors) and varying a relative amount of injection from each injector.

Fuel may be delivered by the injector to the cylinder during a single cycle of the cylinder. Further, the distribution and/or relative amount of fuel delivered from the injector may vary with operating conditions. Furthermore, for a single combustion event, multiple injections of the delivered fuel may be performed per cycle. The multiple injections may be performed during the compression stroke, intake stroke, or any appropriate combination thereof. Also, fuel may be injected during the cycle to adjust the air-to-injected fuel ratio (AFR)

of the combustion. For example, fuel may be injected to provide a stoichiometric AFR. An AFR sensor may be included to provide an estimate of the in-cylinder AFR. In one example, the AFR sensor may be an exhaust gas sensor, such as EGO sensor 128. By measuring an amount of residual oxygen in the exhaust gas, the sensor may determine the AFR. As such, the AFR may be provided as a Lambda (X) value, that is, as a ratio of actual AFR to stoichiometry for a given mixture. Thus, a Lambda of 1.0 indicates a stoichiometric mixture, richer than stoichiometry mixtures may have a lambda value less than 1.0, and leaner than stoichiometry mixtures may have a lambda value greater than 1.

As described above, FIG. 2 shows only one cylinder of a multi-cylinder engine. As such each cylinder may similarly include its own set of intake/exhaust valves, fuel injector(s), spark plug, etc.

Fuel tanks in fuel system 8 may hold fuel with different fuel qualities, such as different fuel compositions. These differences may include different alcohol content, different octane, different heat of vaporizations, different fuel blends, and/or combinations thereof etc.

Engine 10 may further include a knock sensor 82 coupled to each cylinder 14 for identifying abnormal cylinder combustion events. In alternate embodiments, one or more knock sensors 82 may be coupled to selected locations of the engine block. The knock sensor may be an accelerometer on the cylinder block, or an ionization sensor configured in the spark plug of each cylinder. The output of the knock sensor may be combined with the output of a crankshaft acceleration sensor to indicate an abnormal combustion event in the cylinder. In one example, based on the output of knock sensor 82 in one or more defined windows (e.g., crank angle timing windows), abnormal combustion due to one or more of knock and pre-ignition may be detected and differentiated. As an example, pre-ignition may be indicated in response to knock sensor signals that are generated in an earlier window (e.g., before a cylinder spark event) while knock may be indicated in response to knock sensor signals that are generated in a later window (e.g., after the cylinder spark event). Further, pre-ignition may be indicated in response to knock sensor output signals that are larger (e.g., higher than a first threshold), and/or less frequent while knock may be indicated in response to knock sensor output signals that are smaller (e.g., higher than a second threshold, the second threshold lower than the first threshold) and/or more frequent.

In addition, a mitigating action applied may be adjusted based on whether the abnormal combustion was due to knock or pre-ignition. For example, knock may be addressed using spark retard and EGR while pre-ignition is addressed using cylinder enrichment, cylinder enleanment, engine load limiting, and/or delivery of cooled external EGR.

One or more of fuel injector 166, intake valve 150, and exhaust valve 156 may be selectively deactivatable. As discussed at FIG. 1, during conditions when the full torque capability of the engine is not needed, such as low load conditions, cylinder 14 may be selectively deactivated by disabling cylinder fueling and/or the operation of the cylinder's intake and exhaust valves. As such, remaining cylinders that are not deactivated may continue to operate and the engine may continue to spin. The motoring of the engine may result in vacuum being generated which causes oil from across the piston ring to be drawn into the deactivated cylinder. As such, as the duration of cylinder deactivation extends, the amount of oil accumulated in the cylinder may increase. Oil may also be trapped due to the lower cylinder temperature and pressure during the deactivation. During a subsequent reactivation, the trapped oil may act as an ignition source. The ignition may become an issue in particular if the cylinder is reactivated to high load conditions, such as when the cylinder is reactivated with boost operation enabled. Specifically, the accumulated oil may pre-ignite the cylinder, leading to engine damage. To address this pre-ignition, during reactivation of a VDE cylinder to high cylinder load conditions, the cylinder may be selectively enriched for a duration of the reactivation, as shown at FIG. 3. The enrichment may be adjusted based on factors that affect the amount of oil that accumulates in the cylinder. As elaborated at FIG. 4, the enrichment may be adjusted based on the duration of cylinder operation in the VDE mode, as well as the cylinder load level during the reactivation. The enrichment may be further adjusted in a closed-loop fashion based on actual incidences of pre-ignition (that is, the cylinder's pre-ignition history) so as to better anticipate and address cylinder pre-ignition occurrence. After the temporary enrichment, the cylinder may resume stoichiometric combustion.

Returning to FIG. 1, controller 12 is shown as a microcomputer, including microprocessor unit 106, input/output ports 108, an electronic storage medium for executable programs and calibration values shown as read only memory chip 110 in this particular example, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; absolute manifold pressure signal (MAP) from sensor 124, cylinder AFR from EGO sensor 128, and abnormal combustion from knock sensor 82 and a crankshaft acceleration sensor. Engine speed signal, RPM, may be generated by controller 12 from signal PIP. Manifold pressure signal MAP from a manifold pressure sensor may be used to provide an indication of vacuum, or pressure, in the intake manifold.

Storage medium read-only memory 110 can be programmed with computer readable data representing instructions executable by processor 106 for performing the methods described below as well as other variants that are anticipated but not specifically listed. Example routines are shown with reference to FIGS. 3-5.

In this way, the systems of FIGS. 1-2 enable a method for a variable displacement engine wherein while reactivating a cylinder to a higher than threshold load condition (such as when reactivating to high loads and with boost enabled), and before an indication of pre-ignition in the cylinder is received, the reactivated cylinder is enriched. The enrichment is adjusted based on each of cylinder load and a preceding duration of cylinder deactivation. The enrichment is further adjusted in a closed-loop fashion based on pre-ignition incidences occurring during the reactivation. In this way, cylinder pre-ignition in a VDE engine is better anticipated and mitigated.

Now turning to FIG. 3, an example routine 300 is shown for adjusting cylinder operation during reactivation of a cylinder from one or more deactivation conditions. As such, the cylinder may have been deactivated due to various conditions. For example, the cylinder may have been deactivated during an engine shut-down. Alternatively, the cylinder may have been deactivated while the engine continued to operate using remaining engine cylinders. Based on the specific cylinder deactivation scenario, pre-ignition propensities in the cylinder vary. By accordingly adjusting cylinder fueling during reactivation of the cylinder, pre-ignition can be addressed.

At 302, engine operating conditions may be estimated and/or measured. These may include for example, engine speed and load, operator torque demand, boost level, engine temperature, exhaust temperature, MAP, MAF, etc. At 304, based on the estimated operating conditions, it may be determined if cylinder reactivation conditions have been met. Specifically, it may be determined if one or more previously deactivated cylinders need to be reactivated. As such, the one or more cylinders may have been deactivated for various reasons. For example, the cylinders may have been deactivated during an engine shutdown, during an engine idle-stop, during a VDE mode of operation, during a deceleration fuel shut-off (DFSO) operation, etc. In each case, the cylinder(s) may have been deactivated via selectively deactivatable fuel injectors and/or the deactivation of cylinder intake/exhaust valves.

At 306, it is determined if the cylinder(s) are being reactivated from an engine idle-stop condition. For example, in engines configured with stop/start systems, engine cylinders may be selectively deactivated and the engine may be shut down when idle-stop conditions are met. The engine may be restarted, and the cylinders reactivated, when restart conditions are met. If the cylinder reactivation at 306 is determined to be responsive to an engine restart from idle-stop, at 312, the routine includes resuming cylinder fueling and valve operation. In addition, the reactivated cylinders may resume cylinder combustion at or around stoichiometry. In alternate examples, cylinder combustion may be resumed at an alternate air-fuel ratio (e.g., richer or leaner than stoichiometry) based on the engine operating conditions at the restart.

If cylinder reactivation from an idle-stop is not confirmed at 306, at 308 it may be determined if the cylinder(s) are being reactivated from a DFSO condition. For example, fueling of all engine cylinders may be selectively deactivated during selected vehicle deceleration conditions to improve fuel economy. The engine may be restarted, and the cylinders refueled, when torque demand increases and the vehicle resumes acceleration. If the cylinder reactivation at 308 is determined to be responsive to an engine restart from DFSO conditions, the routine returns to 312 to resume cylinder fueling and cylinder combustion at or around stoichiometry (or an alternate air-fuel ratio determined based on engine operating conditions at the restart).

Thus, in response to the cylinder(s) being reactivated from rest or a DFSO condition, the routine includes operating the cylinder(s) at stoichiometry. As such, no pre-emptive pre-ignition mitigating enrichment is required in the reactivated cylinders when the cylinders are reactivated from an idle-stop or a DFSO condition. This is because during the preceding deactivation, there is either not sufficient vacuum generated at the cylinder to draw oil into the deactivated cylinders or there is not sufficient oil accumulation. For example, during an idle-stop engine shutdown, there is neither oil flow nor sufficient vacuum for oil entrapment. In comparison, during a DFSO, even though there may be sufficient vacuum, the time spent by the engine in a DFSO mode may not be long enough to collect sufficient amounts of oil. As a result, during either deactivation, the likelihood of trapped oil acting as an ignition source during the subsequent reactivation is lower. The controller may enrich the reactivated cylinder(s) after receiving an indication of cylinder pre-ignition, the enrichment based on the received indication of pre-ignition.

If cylinder reactivation from DFSO is not confirmed at 308, at 310, it may be determined if the cylinder(s) are being reactivated from a VDE mode. For example, one or more engine cylinders (e.g., of a selected engine bank) may be selectively deactivated during low torque demand conditions to improve fuel economy. The selected cylinders may be deactivated by deactivating fuel and/or valve operation of the cylinders. The cylinders may be reactivated and the engine transitioned to a non-VDE mode when the torque demand increases.

If the cylinder reactivation at 310 is determined to include a transition from VDE mode to non-VDE mode responsive to an increase in torque demand, the routine moves to 313 to determine how long the engine operated in the VDE mode. As such, the longer the duration spent in the VDE mode, the higher the accumulation of oil in the deactivated engine cylinders is expected to be. Accordingly, as elaborated below, during a subsequent reactivation, the reactivated cylinders may need to be enriched. At 314, the routine determines if the cylinder reactivation is to higher than a threshold load. For example, it may be determined if the cylinders are being reactivated in response to a torque demand that is higher than a threshold torque demand. In one example, a higher than threshold torque demand may be received during a passing maneuver of the vehicle. If the demand is not higher than the threshold, at 316, the routine includes reactivating the cylinder by resuming fueling and/or valve operation, and operating the reactivated cylinder at or around stoichiometry. In comparison, if the cylinder is reactivated responsive to a higher than threshold torque demand, at 318, the routine includes reactivating the cylinder by resuming fueling and/or valve operation. In addition, while reactivating the cylinder to the higher load condition and before an indication of pre-ignition in the cylinder is received, the reactivated cylinder is preemptively enriched. The enrichment may be applied immediately, such as from the first engine cycle following reactivation. Alternatively, the enrichment may be delayed by a couple of engine cycles until the reactivated cylinder heats up. Thus, a timing of applying the enrichment in the reactivated cylinder may be based on time (that is, a duration elapsed since the cylinder reactivation), combustion events (that is, a number of combustion events elapsed since the cylinder reactivation), or based on an estimated in-cylinder temperature.

As elaborated at FIG. 4, the enrichment may be adjusted based on each of the (higher than threshold) torque demand and a preceding duration of cylinder deactivation (as determined at 313). Herein, a pre-emptive pre-ignition mitigating enrichment is performed in the reactivated cylinders when the cylinders are reactivated from a VDE mode of operation to an elevated load condition. This is because during the preceding deactivation, even though the cylinder was deactivated, the engine continued to spin and be motored. As a result, vacuum is generated that draws oil into the deactivated cylinder. The trapped oil is then likely to act as an ignition source during the reactivation of the cylinder to higher load conditions. The controller may therefore preemptively enrich the reactivated cylinder to reduce the likelihood of a cylinder pre-ignition event during the reactivation.

As such, if a cylinder pre-ignition event occurs even with the pre-emptive enrichment, the controller may enrich the affected cylinder after receiving the indication of cylinder pre-ignition, the enrichment based on the received indication of pre-ignition. Herein, the pre-emptive enrichment is likely to be less rich than the pre-ignition mitigating enrichment. In addition, as elaborated at FIG. 4, the controller may adjust the pre-emptive enrichment during a subsequent reactivation of the cylinder from a VDE mode in a closed loop fashion.

Now turning to FIG. 4, an example method 400 is shown for preemptively enriching an engine cylinder during reactivation of the cylinder from a VDE mode in response to a higher than threshold torque demand. The method allows pre-ignition events occurring during a transition from VDE mode to non-VDE mode to be reduced.

At 402, the method includes reactivating the cylinder(s). As such, one or more previously deactivated cylinders may be reactivated from a VDE mode to a non-VDE mode in response to a higher than threshold torque demand, as elaborated at FIG. 3. The cylinder may be reactivated by resuming cylinder fueling (e.g., reactivating fuel injectors) and valve operation (e.g., by reactivating intake/exhaust valves). The selected cylinders may be reactivated from a low torque demand condition where valves of the cylinder are closed, fueling is disabled, but the engine is still spinning. As a result, vacuum may be generated that can draw oil into the cylinder. Oil may also be drawn in due to lower temperatures in the cylinder during deactivation operation, as well as lower pressures on the oil control ring of the piston. The oil migrates into the combustion chamber, and collects therein. The trapped oil can then act as an ignition source during subsequent cylinder reactivation. To reduce the propensity for a pre-ignition event, the cylinder may be enriched for a duration of the reactivation. As such, if the cylinder was reactivated from rest or a deceleration fuel shut-off condition, the pre-emptive enrichment may not be required.

At 404, the cylinder enrichment required to preemptively address the pre-ignition may be determined and applied. The cylinder enrichment may be adjusted based on one or more of the torque demand (at the time of cylinder reactivation) and a preceding duration of cylinder deactivation. The cylinder enrichment may also be adjusted based on a window of time since reactivation. In particular, the enrichment may be delivered immediately upon reactivation, or with a delay since the reactivation. The delaying of the enrichment may be based on a duration (e.g., time or number of combustion cycles) elapsed since the reactivation, a distance traveled since the reactivation, and/or based on an estimated in-cylinder temperature, with the enrichment delayed until the in-cylinder temperature is higher than a threshold temperature (where ignition of the oil is likely). Adjusting the enrichment may include one or more of adjusting a degree of richness of the enrichment at 406, and adjusting a number of engine cycles over which the reactivated cylinder is enriched (herein also referred to as the number of enrichment cycles) at 408. For example, the adjusting may include increasing one or more of the degree of richness and the number of engine cycles as the torque demand exceeds the threshold or as the preceding duration of cylinder deactivation increases.

In one example, the controller may determine a desired richer than stoichiometry air-fuel ratio and maintain that air-fuel ratio over the determined number of enrichment cycles. Alternatively, the controller may vary the air-fuel ratio over the determined number of enrichment cycles. This may include increasing the degree of richness over the number of engine cycles. Alternatively, the degree of richness may be decreased over the number of engine cycles such that the enrichment is started at a desired richer than stoichiometric air-fuel ratio and by the end of the number of enrichment cycles, the air-fuel ratio is at or around stoichiometry.

In one example, the enrichment to be applied may be stored in a look-up table of the controller's memory as a function of engine torque, cylinder load, cylinder identity, etc. The controller may use the table to determine the enrichment to be applied for the given cylinder during the reactivation.

At 408, the enrichment may be further adjusted based on a pre-ignition history of the cylinder. Therein, at 409, the enrichment may be increased if a pre-ignition event occurred during a previous (e.g., immediately previous) reactivation of the given cylinder. For example, a degree of richness of the enrichment may be increased (and/or a number of enrichment cycles may be increased) in response to an indication of pre-ignition during a previous reactivation of the cylinder responsive to the higher than threshold torque demand. Likewise, at 410, the enrichment may be decreased if a pre-ignition event occurred during a previous (e.g., immediately previous) reactivation of the given cylinder. For example, the degree of richness of the enrichment may be decreased (and/or a number of enrichment cycles may be decreased) in response to no indication of pre-ignition during the previous reactivation of the cylinder responsive to the higher than threshold torque demand. As elaborated below, based on pre-ignition occurrences, or lack thereof, the controller may update the look-up table for determining cylinder enrichment amounts.

It will be appreciated that while the given reactivated engine cylinder(s) are enriched, the remaining engine cylinders may continue to operate at or around stoichiometry. For example, if one or more engine cylinders of a first engine bank are deactivated during a VDE mode, during the transition back to the non-VDE mode, the one or more engine cylinders of the first engine bank may be enriched for a duration of the reactivation while remaining engine cylinders of a second engine bank are maintained at stoichiometry.

At 412, after operating the engine with the determined pre-emptive enrichment for the determined duration, engine operation may be returned to stoichiometry. For example, after the number of engine cycles of enrichment has elapsed, the controller may resume stoichiometric combustion in the cylinder.

At 414, it may be determined if an indication of pre-ignition was received. As such, even with the pre-emptive enrichment, pre-ignition events may occur. Thus, it may be determined if an indication of pre-ignition was received after the pre-emptive cylinder enrichment was initiated. If not, it may be determined that the pre-emptive enrichment was sufficient to address the pre-ignition propensity in the reactivated cylinder. Accordingly, a look-up table in the controller's memory may be updated. For example, based on the absence of a pre-ignition event during the current reactivation, the controller may trim the enrichment to be applied during a subsequent reactivation of the cylinder (wherein the reactivation is responsive to higher than threshold torque demands).

For example, the reactivating may be a first reactivation and the pre-emptive enriching during the first reactivation may include a first degree of richness and/or a first number of enrichment cycles. In response to no indication of pre-ignition being received during the first reactivation, during a second, subsequent reactivation of the cylinder responsive to the higher than threshold torque demand, the controller may enrich the cylinder with a second degree of richness lower than the first degree of richness. Additionally or optionally, the controller may enrich the cylinder for a second number of enrichment cycles smaller than the first number of enrichment cycles. As an example, during the first reactivation, the reactivated cylinder may be preemptively enriched at 10% enrichment. In response to an indication of no pre-ignition during the first reactivation, the cylinder may be preemptively enriched at 5% enrichment during the second reactivation.

Likewise, the number of enrichment cycles may be adjusted. For example, the number of pre-emptive enrichment cycles applied during a subsequent reactivation may be increased if an incidence of pre-ignition occurred after the pre-emptive enrichment cycles on the current reactivation expired. As an example, during a reactivation from VDE mode, 10 enrichment cycles may be scheduled. However, pre-ignition may occur on the $12^{th}$ cycle. That is, pre-ignition occurs after the pre-emptive enrichment has expired. Consequently, during a subsequent reactivation, the pre-emptive enrichment may be extended to 15 enrichment cycles following reactivation. In the same way, the enrichment cycles may also be clipped if pre-ignition incidences are spaced further from the reactivation. For example, if pre-ignition occurs relatively further away from a reactivation, it may be determined that the pre-ignition event was not caused by the deactivation oil migration.

Thus, if an indication of pre-ignition is received even after the pre-emptive enrichment, at 418, the reactivated cylinder may be further enriched, the enriching based on the indication of pre-ignition. For example, as the indication of pre-ignition increases, the enrichment may be increased, including increasing a degree of richness and/or a number of enrichment cycles.

At 420, it may be determined that the pre-emptive enrichment performed at 404-408 was not sufficient to address the pre-ignition propensity in the reactivated cylinder. Accordingly, the look-up table in the controller's memory may be updated. For example, based on the presence of a pre-ignition event during the current reactivation, the controller may enhance the enrichment to be applied during a subsequent reactivation of the cylinder (wherein the reactivation is responsive to higher than threshold torque demands). With reference to the earlier example where the reactivating is a first reactivation and the pre-emptive enriching during the first reactivation include a first degree of richness and/or a first number of enrichment cycles, in response to an indication of pre-ignition being received during the first reactivation, during the second, subsequent reactivation of the cylinder responsive to the higher than threshold torque demand, the controller may enrich the cylinder with a second degree of richness higher than the first degree of richness. Additionally or optionally, the controller may enrich the cylinder for a second number of enrichment cycles larger than the first number of enrichment cycles. As an example, during the first reactivation, the reactivated cylinder may be preemptively enriched at 10% enrichment. In response to an indication of pre-ignition during the first reactivation, the cylinder may be preemptively enriched at 20% enrichment during the second reactivation.

In this way, the enrichment may be adjusted in a closed-loop fashion based on pre-ignition incidences occurring during the reactivation. By adjusting the enrichment in a closed-loop fashion, the enrichment can be optimized, reducing fuel wastage and reducing exhaust emissions. By applying a pre-ignition mitigating enrichment preemptively, cylinder cooling is achieved which reduces the likelihood of pre-ignition events in the cylinder during reactivation to high loads.

FIG. 6 shows an example enrichment in a cylinder during reactivation from VDE mode to non-VDE mode. In particular, map 600 depicts adjusting of fuel injection during reactivation of a cylinder. Map 600 depicts exhaust valve timing at plot 602 (dashed line), intake valve timing at plot 604 (solid line), piston position at plot 608, example fuel injection profiles at 610-612 (relative to spark event 614) and an example output of a knock sensor during the cylinder reactivation at 616-618.

During engine operation, each cylinder within the engine typically undergoes a four stroke cycle: the cycle includes the intake stroke, compression stroke, power (or expansion) stroke, and exhaust stroke. During the intake stroke, generally, the exhaust valve closes (plot 602, dashed line) and intake valve opens (plot 604, solid line). Air is introduced into the cylinder via the intake manifold, and the cylinder piston moves to the bottom of the cylinder so as to increase the volume within the combustion chamber (plot 608). The position at which the piston is near the bottom of the cylinder and at the end of its stroke (e.g. when the combustion chamber is at its largest volume) is typically referred to by those of skill in the art as bottom dead center (BDC). During the compression stroke, the intake valve and exhaust valve are closed. The piston moves toward the cylinder head so as to compress the air within the cylinder. The point at which the piston is at the end of its stroke and closest to the cylinder head (e.g. when the combustion chamber is at its smallest volume) is typically referred to by those of skill in the art as top dead center (TDC).

In a process hereinafter referred to as injection, fuel is introduced into the combustion chamber. In a process hereinafter referred to as ignition or spark, the injected fuel is ignited by known ignition means such as a spark plug, resulting in combustion. During the expansion stroke, the expanding gases push the piston back to BDC. A crankshaft coupled to the piston converts piston movement into a rotational torque of the rotary shaft. Finally, during the exhaust stroke, the exhaust valve opens to release the combusted air-fuel mixture to the exhaust manifold and the piston returns to TDC.

Note that the above is shown merely as an example, and that intake and exhaust valve opening and/or closing timings may vary, such as to provide positive or negative valve overlap, late intake valve closing, or various other examples.

A first engine cycle (Engine cycle 1) is depicted including each of exhaust, intake, compression, and power strokes. A second engine cycle (Engine cycle 2) immediately follows Engine cycle 1 and also includes each of exhaust, intake, compression, and power strokes. As such, engine cycles 1-2 are consecutive engine cycles of a given engine cylinder that is being reactivated. In particular, the given cylinder is deactivated during engine cycle 1. Consequently, there is no valve operation or fueling in the cylinder during engine cycle 1, as shown. The cylinder may have been deactivated in response to a drop in torque demand wherein the reduced torque demand could be sufficiently met by remaining active cylinders. In response to an increase in torque demand to higher than threshold levels, such as due to a passing maneuver of the vehicle, the cylinder may be reactivated during engine cycle 2. Consequently, valve operation (602-604) is resumed in the cylinder during engine cycle 2. In addition, fueling is resumed.

As such, if fueling is resumed at stoichiometry, as shown at hatched bar 610, a cylinder pre-ignition event may occur during the compression stroke, before cylinder spark event 614. This is due to ignition of oil that was trapped in the cylinder during the preceding deactivation, including during engine cycle 1. The pre-ignition event may be indicated based on the output 616 of an engine knock sensor being higher than threshold 619 in a window before the spark event. While the depicted example shows pre-ignition occurring during the first event after reactivation, in alternate examples, pre-ignition may not happen on the first event after reactivation as the cylinder may have cooled. However, pre-ignition may occur after a few engine cycles at high load have elapsed.

To preemptively address pre-ignition arising from oil trapped in the cylinder during the preceding cylinder deactivation, the controller may instead enrich the cylinder during the reactivation. Specifically, at engine cycle 2, fueling of the engine cylinder may be adjusted to be richer than stoichiometry, as indicated by bar 612 (which includes added fuel over and above the stoichiometric fuel amount of hatched bar 610). As a result of the enrichment, pre-ignition may be reduced and no indication of pre-ignition may be received during the reactivation, as indicated by output 618 of the engine knock sensor being lower than threshold 619 in the window before the spark event. In this way, pre-ignition is averted by enriching the cylinder at the time of reactivation from VDE conditions (that is, during the transition).

As discussed above, pre-ignition may occur after a few engine cycles at high load (e.g., higher than threshold load) have elapsed instead of immediately upon reactivation. Accordingly, in some examples, the pre-emptive enrichment may also be delayed instead of being performed immediately upon reactivation. The controller may, in open-loop fashion, keep track of how soon after reactivation pre-ignition tends to occur, and adjust the earliest of the number of reactivation cycles when enrichment is deployed. For example, if the controller determines that pre-ignition tends to occur at engine cycle 10 following reactivation, the controller may apply the pre-emptive enrichment of FIG. 6 (612) at engine cycle 10, or at a couple of engine cycles before engine cycle 10, such as at engine cycle 8 or 9.

Figure 5:
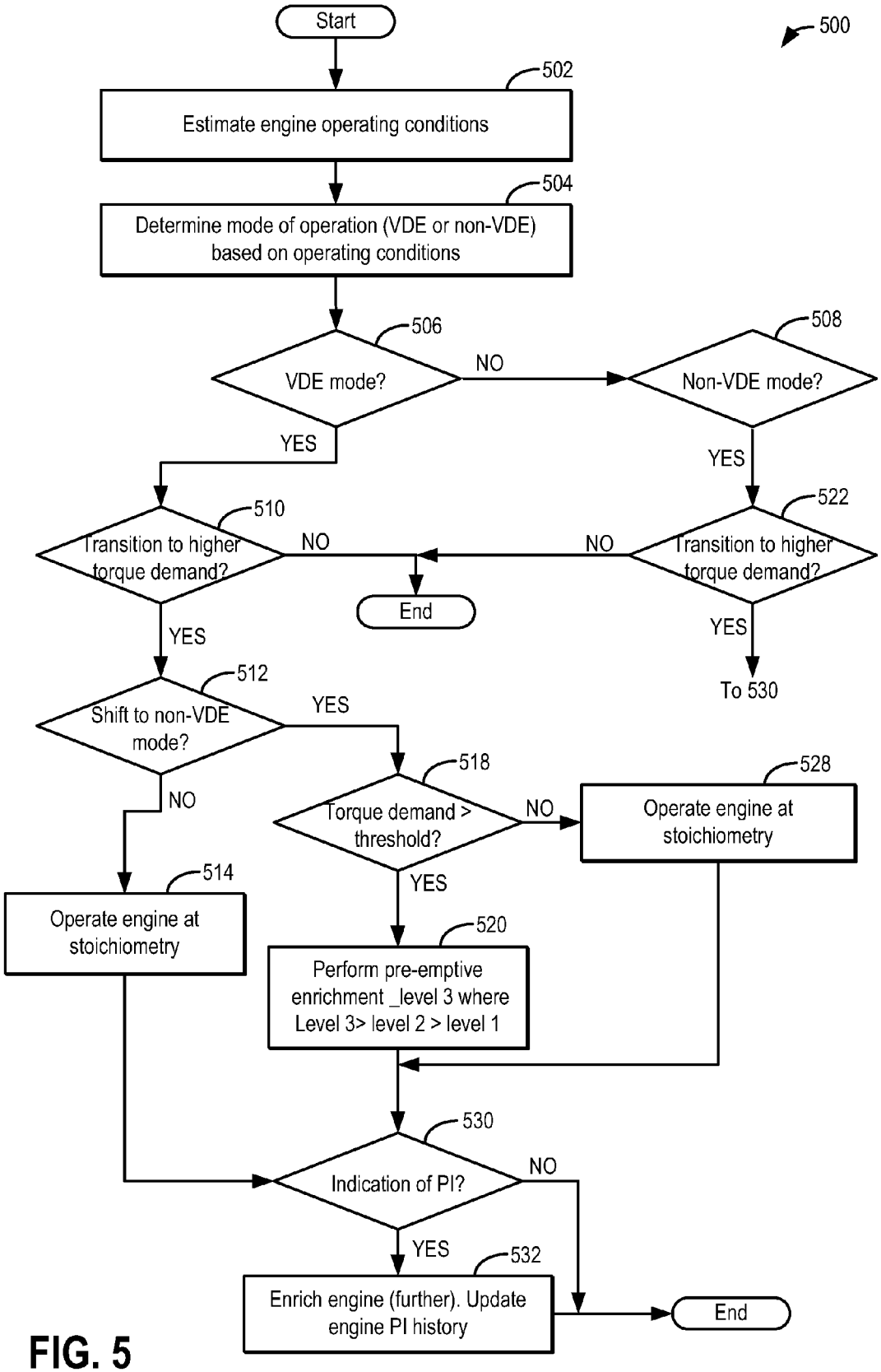
FIG. 5 shows a high level flow chart for enriching a cylinder during selected transitions from a VDE mode to a non-VDE mode.

Now turning to FIG. 5, an example routine 500 is shown for adjusting fueling of a cylinder during a transition between high and low load conditions. As such, the fueling, including a degree of pre-ignition mitigating pre-emptive enriching, may differ based on whether the transition further includes a transition between VDE and non-VDE modes, as well as the directionality of the transition.

At 502, engine operating conditions may be estimated and/or measured. At 504, based on the estimated engine operating conditions, an engine mode of operation may be determined. For example, during low operator torque demand conditions, a VDE mode may be selected to provide fuel economy benefits. In comparison, during high operator torque demand conditions, a non-VDE mode may be selected to provide performance benefits.

At 506, it may be confirmed that a VDE mode has been selected. For example, it may be determined that the engine is operating with one or more cylinders of a given engine bank deactivated while engine cylinders of a remaining engine bank are active. Upon confirming that the engine is operating in the VDE mode with one or more cylinders deactivated, the routine moves to 510 to determine if there is a change in engine operating conditions leading to a transition to higher cylinder load. For example, it may be determined if there is an increase in operator torque demand. If not, the routine may end with the engine continuing to operate in the VDE mode. If an increase in torque demand is confirmed, at 512 it may be determined if the increase in torque demand requires a transition back to non-VDE mode. For example, it may be determined if the deactivated cylinders need to be reactivated. If the cylinders do not need to be reactivated and the increase in torque demand can be met by increasing the cylinder load of the active engine cylinders, the routine moves to 514 to determine if the torque demanded is higher than a threshold.

If the increase in torque demand is not sufficiently high, the engine may continue to operate in the VDE mode while increasing the average cylinder load of the active cylinders. In addition, since pre-ignition is not anticipated due to the lower load increase, the engine may be operated at stoichiometry at 514 and a pre-emptive cylinder enrichment may not be scheduled.

As such, cylinder load of active cylinders while operating in the VDE mode may not rise sufficiently high to cause pre-ignition. In particular, as the load increases, there may be more borderline knock and hence spark retard from MBT may be applied. The resulting fuel loss due to large borderline spark retard may be higher than a corresponding fuel loss from running the engine with all cylinders in a non VDE mode with a lower average cylinder load. In other words, if the cylinder load increases high enough, the engine may be transitioned to a non-VDE mode where the lower average cylinder load would incur a lower risk of pre-ignition.

However, in alternate examples, while operating an engine in the VDE mode with one or more cylinders deactivated, the controller may perform a pre-emptive enrichment in the active cylinders at a first level (Level_1 for a first duration with a first degree of richness. The first level of enrichment may be based at least on the torque demand and the engine's pre-ignition history. For example, the engine may be a V6 engine operating in a V3 mode with 3 cylinders of a first bank deactivated and 3 cylinders of a second bank active. In response to the increase in torque demand, the average cylinder load of the 3 cylinders of the second engine bank may be increased while also adjusting their air-fuel ratio to operate them richer than stoichiometry for a duration. At the same time, the first bank of cylinders may be maintained deactivated. After the duration of enrichment, stoichiometric combustion may be resumed in the second engine bank.

If at 512 a transition to non-VDE mode is confirmed, deactivated cylinders may be reactivated. For example, it may be determined that the increase in torque demand cannot be met by increasing the cylinder load of the active engine cylinders, but requires reactivation of the deactivated cylinders. The routine then moves to 518 to determine if the torque demanded is higher than a threshold. If the increase in torque demand is not sufficiently high, the engine may transition to the non-VDE mode by reactivating fuel and valve operation in the inactive cylinders. In addition, since pre-ignition is not anticipated during the reactivation due to the lower increase in torque demand, the engine may be operated at stoichiometry at 528.

If the torque demand is higher, there may be a higher likelihood of pre-ignition occurring in the reactivated cylinders due to ignition of oil accumulating in the deactivated cylinders during the preceding VDE mode. Thus, in response to a higher than threshold torque demand received requiring a transition from operating an engine in the VDE mode to operating in a non-VDE mode, the controller may reactivate previously deactivated engine cylinders by resuming fuel and valve operation. In addition, the controller may perform a preemptive enrichment at a third level at 520. (Level_3). The third level may be higher than the first level. Herein, the reactivated cylinders may be enriched for a third duration with a third degree of richness, the third duration longer than the first duration, and the third degree of richness higher than the first degree of richness. The third level of enrichment may be based at least on the torque demand, the duration of operation in the VDE mode, and the engine's pre-ignition history. For example, where the engine is a V6 engine operating in a V3 mode with 3 cylinders of a first bank deactivated and 3 cylinders of a second bank active, in response to the increase in torque demand, the 3 cylinders of the first engine bank may be reactivated while also adjusting their air-fuel ratio to operate them richer than stoichiometry for a duration. At the same time, combustion at the second bank of cylinders may be maintained at stoichiometry. After the duration of enrichment, stoichiometric combustion may be resumed in the first engine bank.

As discussed above, the pre-emptive enrichment may be performed for the number of enrichment cycles immediately upon cylinder reactivation. Alternatively, the pre-emptive enrichment may be delayed until a defined duration has elapsed since the reactivation, and/or until an in-cylinder temperature of the reactivated cylinder is higher than a threshold.

Returning to 506, if a VDE mode of operation is not confirmed, a non-VDE mode of operation may be confirmed at 508. Therein, all engine cylinders may be active. Next, at 522, the routine determines if there is a change in engine operating conditions leading to a transition to higher cylinder load. For example, it may be determined if there is an increase in operator torque demand. If not, the routine may end with the engine continuing to operate in the non-VDE mode. If there is a transition to higher load, at 522 it may be determined if the torque demanded is higher than the threshold. If the increase in torque demand is not sufficiently high, the engine may continue to operate in the non-VDE mode and since pre-ignition is not anticipated, the engine may be operated at stoichiometry at 528.

If the torque demand is higher than the threshold, there may be a higher likelihood of pre-ignition occurring in the cylinders due to the high load conditions. However, a pre-emptive enrichment may not be performed in the no-VDE mode based on a load change. This is because such a pre-emptive enrichment may occur too frequently in the non-VDE mode, leading to emission issues.

However, in alternate examples, in response to a higher than threshold torque demand received while operating the engine with all cylinders active in the non-VDE mode, the controller may perform a pre-emptive enrichment at a second level for a second duration with a second degree of richness, the second duration longer than the first duration but shorter than the third duration, and the second degree of richness higher than the first degree of richness but smaller than the third degree of richness. The second level of enrichment may be based at least on the torque demand and the engine's pre-ignition history. For example, where the engine is a V6 engine operating in a V6 mode with 3 cylinders of a first bank and 3 cylinders of a second bank active, in response to the increase in torque demand, the 6 cylinders of the engine may be operated richer than stoichiometry for a duration. After the duration of enrichment, stoichiometric combustion may be resumed in both engine banks.

From each of 514, 528, and 522, the routine may move to 530 to determine if there is an indication of pre-ignition. In one example, it may be determined if there is an indication of pre-ignition in spite of the pre-emptive enrichment applied during the transition from VDE mode to non-VDE mode. In another example, it may be determined if there is an indication of pre-ignition while operating the engine at stoichiometry while in the VDE mode or the non-VDE mode. The indication of pre-ignition may be based on the output of an engine knock sensor estimated in a defined crank angle window (e.g., before a spark event in a cylinder) being higher than a threshold. In response to the indication of pre-ignition, at 532, at least the pre-ignition affected cylinder may be enriched and the engine's pre-ignition history may be updated. During subsequent pre-emptive enrichments operations, such as those performed during selected VDE to non-VDE transitions, the enrichment may be adjusted based on the updated pre-ignition history.

It will be further appreciated that while the routine of FIG. 6 adjusts the enrichment applied during cylinder reactivation based on the increase in torque demand as well as whether a transition from VDE to non-VDE mode is required, in still further embodiments, the enrichment may be further based on boost enablement. For example, a pre-emptive enrichment may not be required when transitioning from a VDE mode with boost disabled to a non-VDE mode with boost disabled in response to an increase in torque demand. However a pre-emptive enrichment may be required when transitioning from a VDE mode with boost enabled to a non-VDE mode with boost enabled in response to an increase in torque demand. As such, an increase in torque demand can be met much faster by reactivating engine cylinders and transitioning out of a VDE mode. This is because a VDE transition occurs on an engine cycle-by-cycle basis. In comparison, if the increase in torque demand is met by maintaining the status of engine cylinders and enabling boost, there may be a delay involved in delivering the increased torque demand due to turbo lag incurred in spinning up the turbine. As a result, the increase in torque demand may be met faster by reactivating VDE engine cylinders.

Now turning to FIG. 7, performing of an example cylinder enrichment during reactivation of engine cylinders from a VDE mode, as well as a closed loop adjustment of the enrichment, is shown. In particular, map 700 depicts torque demand at plot 702, mode of engine operation (VDE or non-VDE) at plot 704, combustion air-fuel ratio of a given engine cylinder at plot 706, and the output of a knock sensor coupled to the given engine cylinder at plot 708.

Prior to t1, the operator torque demand (plot 702) may be lower. Consequently, to improve engine fuel economy, one or more engine cylinders (e.g., cylinders of a first engine bank) may be deactivated while the torque demand may be met by the remaining active cylinders (e.g., cylinders of a second engine bank). That is, prior to t1, the engine may be operating in a VDE mode (plot 704). The cylinders may be deactivated by deactivating cylinder fuel injectors (as shown at plot 706) and/or valve operation. In particular, plot 706 shows the combustion conditions of a deactivated engine cylinder.

At t1, in response to an increase in torque demand to higher than threshold level 703, the engine mode may be transitioned from the VDE mode to the non-VDE mode. Specifically, the deactivated cylinder may be reactivated by resuming cylinder fueling and valve operation. In anticipation of potential pre-ignition events occurring in the cylinder during reactivation to high cylinder loads, at t1, during the cylinder reactivation, the cylinder may be enriched. In particular, the reactivated cylinder may be operated richer than stoichiometry with a degree of richness d1. In addition, the enrichment may be performed for a duration corresponding to a first number of enrichment cycles n1. After the first number of enrichment cycles have elapsed (between t1 and t2), stoichiometric combustion may be resumed in the reactivated cylinder. By enriching the cylinder during the reactivation, a pre-ignition in the cylinder is averted. As such, if the cylinder were not enriched during the reactivation, an indication of pre-ignition may be received, as indicated based on the output of a knock sensor (plot 708) being higher than threshold 709.

At t2, in response to a drop in torque demand, the engine may be transitioned back to a VDE mode and one of more cylinders (e.g., of the first or second bank) may be deactivated. The cylinders may then remain deactivated until t3 when due to a rise in torque demand, the cylinders are reactivated. At t3, the increase in torque demand may be to less than threshold level 703. Consequently, even though the cylinders are reactivated, a pre-emptive enrichment may not be required since pre-ignition is not anticipated under these conditions. Consequently, at t3, the reactivated engine cylinders may be operated at or around stoichiometry.

At t4, in response to a drop in torque demand, the engine may be transitioned back to a VDE mode and one or more cylinders (e.g., of the first or second bank) may be deactivated. The cylinders may then remain deactivated until t5 when due to a rise in torque demand, the cylinders are reactivated. At t5, in response to an increase in torque demand to higher than threshold level 703, the engine mode may be transitioned from the VDE mode to the non-VDE mode.

Here, as at t1, in anticipation of potential pre-ignition events occurring in the cylinder during reactivation to high cylinder loads, during the cylinder reactivation, the cylinder may be enriched. The enrichment may be adjusted in a closed loop fashion based on the incidence of pre-ignition during the previous reactivation. In particular, the reactivated cylinder may be operated richer than stoichiometry with a degree of richness d2. In addition, the enrichment may be performed for a duration corresponding to a second number of enrichment cycles n2. Herein, due to no indication of pre-ignition being received during the preceding cylinder reactivation to higher than threshold level 703 (at t1), the cylinder enrichment performed at t5 may be smaller than the cylinder enrichment performed at t1. In particular, the reactivated cylinder may be operated with a degree of richness d2 that is smaller than degree of richness d1 (applied at t1). In addition, the second number of enrichment cycles n2 may be smaller than the first number of enrichment cycles n1 (performed at t1).

As such, if an indication of pre-ignition 710 was received during the previous cylinder reactivation (such as indicated based on the output of a knock sensor, at plot 708, being higher than threshold 709), in spite of the pre-emptive enrichment (at t1), then the cylinder enrichment performed at t5 may be larger than the cylinder enrichment performed at t1. In particular, as shown at dashed plot 707, the reactivated cylinder may be operated with a degree of richness d3 that is larger than degree of richness d1 (applied at t1). In addition, the number of enrichment cycles n3 may be larger than the first number of enrichment cycles n1 (performed at t1).

While the depicted example shows the pre-emptive enrichment being performed at t1 and t5, in alternate examples, the enrichment may be delayed by a few cycles since a few cycles may have elapsed before the cylinder would be hot enough to pre-ignite. The delay may also be adjusted based on a closed-loop learning of how early a pre-ignition event may have occurred after transitioning back to non-VDE. For example, the controller may determine a number of engine cycles elapsed between t1 and indication of pre-ignition 710 if an enrichment is not performed. The controller may then adjust the enrichment to be performed after the determined number of engine cycles has elapsed on a subsequent reactivation. For example, if indication 710 occurs 10 engine cycles after t1, the pre-emptive enrichment performed at t5 may be delayed till 10 engine cycles after t5 have elapsed.

After the number of enrichment cycles (n2 or n3) have elapsed (after t5), stoichiometric combustion may be resumed in the reactivated cylinder. In this way, by enriching the cylinder during the reactivation in a closed-loop fashion, further incidences of pre-ignition in the cylinder are averted.

In one example, during a first cylinder reactivation from engine spinning to higher than threshold cylinder load, a controller may enrich the reactivated cylinder before receiving an indication of cylinder pre-ignition. In comparison, during a second cylinder reactivation from engine rest to the higher than threshold cylinder load, the controller may operate the reactivated cylinder at stoichiometry before receiving an indication of cylinder pre-ignition. The enriching during the first cylinder reactivation may include enriching with a degree of richness based on each of the higher than threshold cylinder load and a preceding duration of cylinder deactivation. The enriching may further include enriching for a number of engine cycles based on each of the higher than threshold cylinder load and a preceding duration of cylinder deactivation, the degree of richness decreased as the number of engine cycles progress, the cylinder operated at stoichiometry after the number of engine cycles has elapsed. Herein, during a deactivation immediately preceding the first cylinder reactivation, more oil is pumped into the cylinder due to higher engine vacuum, while during a deactivation immediately preceding the second cylinder reactivation, less oil is pumped into the cylinder due to lower engine vacuum. In one example, during the first cylinder reactivation and the deactivation preceding the first cylinder reactivation, engine boost may be enabled.

In response to an indication of cylinder pre-ignition received during the first or second cylinder reactivation, the reactivated cylinder may be enriched based on the indication. The second cylinder reactivation may include one of a cylinder reactivation from an idle-stop condition and a cylinder reactivation from a deceleration fuel shut-off condition. In comparison, the first cylinder reactivation may include a cylinder reactivation from a VDE mode.

In one example, the enriching during the first cylinder reactivation may be a first enrichment. The method may further include, during a third cylinder reactivation from engine spinning to higher than threshold cylinder load following the first cylinder reactivation, wherein an indication of pre-ignition is received during the first cylinder reactivation, enriching the reactivated cylinder before receiving an indication of cylinder pre-ignition with a higher degree of richness than the first enrichment. That is, the enrichment may be increased responsive to the indication of pre-ignition. During a fourth cylinder reactivation from engine spinning to higher than threshold cylinder load following the first cylinder reactivation, wherein an indication of pre-ignition is not received during the first cylinder reactivation, the method may include enriching the reactivated cylinder before receiving an indication of cylinder pre-ignition with a lower degree of richness than the first enrichment. That is, the enrichment may be decreased or trimmed responsive to no indication of pre-ignition.

Now turning to FIG. 8, performing of an example cylinder enrichment during transition of engine cylinders between VDE and non-VDE modes is shown. In particular, map 800 depicts torque demand at plot 802, mode of engine operation (VDE or non-VDE) at plot 804, combustion air-fuel ratio of a given engine cylinder at plot 806, and the output of a knock sensor coupled to the given engine cylinder at plot 808.

Prior to t1, based on the operator torque demand (plot 802), the engine may be operating with all cylinders firing at stoichiometry (plot 806) and no cylinders deactivated. That is, the engine may be in a non-VDE mode (plot 804). At t1, there may be a small rise in torque demand responsive to which average cylinder loads may be increased while continuing to operate the engine in a non-VDE mode with cylinders combusting at stoichiometry. Herein, no pre-emptive enrichment of cylinders is required due to the low likelihood of pre-ignition. At t2, there may be a further rise in torque demand to higher than a threshold level 803. In response to the elevated torque demand, the average cylinder load may be increased while continuing to operate the engine in the non-VDE mode. As such, cylinder pre-ignition may not occur during the high load conditions, and no pre-emptive enrichment may be performed. As such, since the depicted magnitude of load change occurs frequently while operating in the non-VDE mode, a pre-emptive enrichment performed during a load increase while in the non-VDE mode would impact emissions if triggered often.

At t3, there may be a drop in torque demand. To improve engine fuel economy, one or more engine cylinders (e.g., cylinders of a first engine bank) may be deactivated while the torque demand may be met by the remaining active cylinders (e.g., cylinders of a second engine bank). Thus at t3, the engine may be transitioned from the non-VDE mode to a VDE mode wherein one or more cylinders are deactivated by deactivating cylinder fuel injectors (as shown at plot 806) and/or valve operation. In particular, plot 806 shows the combustion conditions of an engine cylinder selected for selective deactivation.

At t4, in response to an increase in torque demand to lower than threshold level 803, average cylinder loads of active cylinders may be increased with the active cylinders combusting at stoichiometry, while continuing to operate the engine in a VDE mode. At t5, the torque demand may further increase but remain below threshold level 803. In response to the elevated torque demand at t5, the cylinders may be reactivated and the engine may be transitioned back to a non-VDE mode. Herein, no pre-emptive enrichment of cylinders is required due to the low likelihood of pre-ignition. Between t5 and t6, the engine may operate in the non-VDE mode with all cylinders combusting at stoichiometry.

At t6, in response to a drop in torque demand, as at t3, the engine may be transitioned from the non-VDE mode to a VDE mode wherein one or more cylinders are deactivated by deactivating cylinder fuel injectors (as shown at plot 806) and/or valve operation.

At t7, torque demand may increase again to above threshold level 803. In response to the increase in torque demand to higher than threshold level 803, the engine mode may be transitioned back from the VDE mode to the non-VDE mode. Specifically, the deactivated cylinders may be reactivated by resuming cylinder fueling and valve operation. However, since cylinder pre-ignition can occur during the cylinder reactivation to high load condition, a pre-emptive enrichment may be performed. Specifically, the reactivated cylinders may be temporarily enriched during the increase in cylinder load at t7. The enrichment may be based on the increase in torque demand, as well as the preceding duration of operation in the VDE mode (that is, duration from t6 to t7). As such, the enrichment performed at t7 may be larger than the enrichment performed at t2, with a higher degree of richness and over a larger number of enrichment cycles. This is because the propensity for pre-ignition during reactivation of a cylinder to higher than a threshold load during a transition from VDE mode to non-VDE mode is higher than the propensity for pre-ignition during a corresponding increase in cylinder load while staying in the VDE mode or in the non-VDE mode. As such, after the determined number of enrichment cycles determined at t7 have elapsed, stoichiometric cylinder combustion may be resumed. By performing the pre-emptive enrichment at t7, pre-ignition may be averted, as indicated by the output of a knock sensor (plot 808) remaining below a pre-ignition threshold 809.

In this way, by varying a pre-emptive enrichment of a cylinder during an increase in torque demand and cylinder load to higher than threshold levels, based on whether the cylinder is being reactivated or is maintained active, the different pre-ignition propensities can be appropriately addressed.

It will be appreciated that while the examples of FIGS. 7-8 depict preemptive enrichments performed in anticipation of a pre-ignition event and before an indication of cylinder pre-ignition is received, pre-ignition events may occur even after the preemptive enrichment. If they do occur, the controller may further enrich the affected cylinder to address the pre-ignition. In addition, the preemptive enrichment of the cylinder may be updated in a closed-loop fashion based on feedback regarding pre-ignition incidences. For example, subsequent preemptive enrichments may be increased to better address further pre-ignition.

As an example, a method for an engine may comprise, in response to a higher than threshold torque demand received while operating with boost enabled and one or more cylinders deactivated, reactivating the one or more cylinders while maintaining boost; and enriching the reactivated cylinders for a duration of the reactivation before receiving an indication of pre-ignition. The enriching may be based on each of the torque demand, engine boost level, and a preceding duration of cylinder deactivation. The one or more deactivated cylinders may be coupled to a first engine bank, the engine further including a second engine bank, wherein during the reactivation, combustion at cylinders of the second engine bank is maintained at stoichiometry. The controller may also increase boost responsive to the higher than threshold torque demand after reactivating the one or more cylinders. In comparison, in response to the higher than threshold torque demand received while operating with boost disabled and the one or more cylinders deactivated, the controller may reactivate the one or more cylinders while maintaining boost disabled and while further maintaining cylinder combustion at stoichiometry until an indication of pre-ignition is received.

As another example, an engine system may comprise an engine including a plurality of cylinders; a selectively deactivatable fuel injector coupled to each engine cylinder; selectively deactivatable intake and/or exhaust valves coupled to each engine cylinder; and a knock sensor for sensing abnormal cylinder combustion. The engine system may further include a controller with computer readable instructions stored on non-transitory memory for: selectively deactivating one or more engine cylinders in response to a decrease in engine torque demand; and in response to an increase in torque demand to higher than a threshold cylinder load, reactivating the one or more deactivated engine cylinders; and enriching the reactivated cylinders with a degree of richness for a number of engine cycles since the engine reactivation, the degree of richness and the number of engine cycles adjusted based on each of cylinder load and a duration of the selective deactivation.

The enriching may include, during a first cylinder reactivation to the higher than threshold cylinder load, enriching the reactivated cylinders at a first, lower degree of richness for a first, smaller number of engine cycles in response to no indication of pre-ignition (PI); and during a second cylinder reactivation to the higher than threshold cylinder load, enriching the reactivated cylinders at a second, higher degree of richness for a second, larger number of engine cycles in response to an indication of PI. During a first cylinder reactivation to cylinder load higher than a threshold load, the enriching of the reactivated cylinder may be performed at a first rate in response to an indication of PI; and during a second cylinder reactivation to cylinder load higher than the threshold load, the enriching of the reactivated cylinder may be performed at a second rate before an indication of PI, the second rate higher than the first rate.

In another representation, a method for an engine includes, while reactivating a cylinder responsive to a higher than threshold torque demand, and before an indication of pre-ignition in the cylinder is received, enriching the reactivated cylinder after a number of engine cycles since the reactivation have elapsed, the enrichment adjusted based on each of the torque demand and a preceding duration of cylinder deactivation, the number of enrichment cycles based on pre-ignition incidence in the reactivated cylinder. The number of engine cycles after which the enrichment is initiated on the cylinder reactivation may be learned in a closed loop manner in response to feedback from a knock sensor. Thus, in response to feedback from the knock sensor being received sooner after the cylinder reactivation, the enrichment may be initiated after a smaller number of engine cycles. In comparison, in response to feedback from the knock sensor being received later after the cylinder reactivation, the enrichment may be initiated after a larger number of engine cycles.

In still another representation, a method for an engine includes, while transitioning a cylinder from a VDE mode to a non-VDE mode responsive to a higher than threshold torque demand, and before an indication of pre-ignition in the cylinder is received, enriching the reactivated cylinder based on feedback from a knock sensor, the feedback received during a previous cylinder transition from a VDE mode to a non-VDE mode responsive to the higher than threshold torque. The enrichment is adjusted based on each of the torque demand and a preceding duration of cylinder deactivation, the number of enrichment cycles based on the feedback from the knock sensor.

In this way, cylinder pre-ignition induced during cylinder reactivation by oil trapped inside the deactivated cylinder can be better addressed. By better identifying selected cylinder reactivation conditions where the trapped oil can act as an ignition source, pre-ignition can be better anticipated and addressed by enriching the selected cylinders during the reactivation. As such, this reduces fuel wastage that may occur if cylinders were always enriched during any reactivation. By adaptively cylinder pre-ignition propensities during selected VDE reactivations, and adjusting the pre-emptive cylinder enrichment in a closed-loop fashion based on the occurrence of pre-ignition events during the reactivation, pre-ignition mitigation can be further optimized. Overall, cylinder pre-ignition can be better addressed in a variable displacement engine during reactivation to high loads and performance of the variable displacement engine can be improved.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

while reactivating a cylinder responsive to a higher than threshold torque demand, and before an indication of pre-ignition in the cylinder is received, enriching the reactivated cylinder, the enrichment adjusted based on each of the torque demand and a preceding duration of cylinder deactivation.

2. The method of claim 1, wherein adjusting the enrichment includes one or more of adjusting a degree of richness and a number of engine cycles over which the reactivated cylinder is enriched.

3. The method of claim 2, wherein the adjusting includes increasing one or more of the degree of richness and the number of engine cycles as the torque demand exceeds the threshold or as the preceding duration of cylinder deactivation increases.

4. The method of claim 3, further comprising, after the number of engine cycles of enrichment has elapsed, resuming stoichiometric combustion in the cylinder.

5. The method of claim 3, wherein the enrichment is further adjusted based on a pre-ignition history of the cylinder, a degree of richness of the enrichment increased in response to an indication of pre-ignition during a previous reactivation of the cylinder responsive to the higher than threshold torque demand, the degree of richness of the enrichment decreased in response to no indication of pre-ignition during the previous reactivation of the cylinder responsive to the higher than threshold torque demand.

6. The method of claim 2, wherein the degree of richness is decreased over the number of engine cycles.

7. The method of claim 1, wherein enriching the reactivated cylinder includes reactivating after a delay since the reactivation, the delay based on one or more of a duration elapsed since the reactivation, a number of engine cycles elapsed since the reactivation, and an estimated in-cylinder temperature.

8. The method of claim 1, wherein the reactivating is a first reactivation and wherein the enriching during the first reactivation includes a first degree of richness, the method further comprising, in response to no indication of pre-ignition being received during the first reactivation, during a second, subsequent reactivation of the cylinder responsive to the higher than threshold torque demand, enriching the cylinder with a second degree of richness lower than the first degree of richness.

9. The method of claim 1, wherein the cylinder is reactivated from a low torque demand condition where valves of the cylinder are closed and the engine is spinning.

10. The method of claim 1, further comprising, in response to the cylinder being reactivated from rest or a deceleration fuel shut-off condition, operating the cylinder at stoichiometry, and enriching the reactivated cylinder after receiving an indication of pre-ignition in the cylinder.

11. A method for an engine, comprising:

during a first cylinder reactivation from engine spinning to higher than threshold cylinder load, enriching the reactivated cylinder before receiving an indication of cylinder pre-ignition; and during a second cylinder reactivation from engine rest to the higher than threshold cylinder load, operating the reactivated cylinder at stoichiometry before receiving an indication of cylinder pre-ignition.

12. The method of claim 11, wherein the enriching during the first cylinder reactivation includes enriching with a degree of richness based on each of the higher than threshold cylinder load and a preceding duration of cylinder deactivation.

13. The method of claim 12, wherein the enriching further includes enriching for a number of engine cycles based on each of the higher than threshold cylinder load and a preceding duration of cylinder deactivation, the degree of richness decreased as the number of engine cycles progress, the cylinder operated at stoichiometry after the number of engine cycles has elapsed.

14. The method of claim 11, wherein during a deactivation immediately preceding the first cylinder reactivation, more oil is pumped into the cylinder, and wherein during a deactivation immediately preceding the second cylinder reactivation, less oil is pumped into the cylinder, and wherein during the first cylinder reactivation and the deactivation preceding the first cylinder reactivation, engine boost is enabled.

15. The method of claim 11, further comprising, in response to the indication of cylinder pre-ignition during the first or second cylinder reactivation, enriching the reactivated cylinder based on the indication.

16. The method of claim 11, wherein the second cylinder reactivation includes one of a cylinder reactivation from an idle-stop condition and a cylinder reactivation from a deceleration fuel shut-off condition.

17. The method of claim 11, wherein the enriching during the first cylinder reactivation is a first enrichment, the method further comprising, during a third cylinder reactivation from engine spinning to higher than threshold cylinder load following the first cylinder reactivation, wherein an indication of pre-ignition is received during the first cylinder reactivation, enriching the reactivated cylinder before receiving an indication of cylinder pre-ignition with a higher degree of richness than the first enrichment; and during a fourth cylinder reactivation from engine spinning to higher than threshold cylinder load following the first cylinder reactivation, wherein an indication of pre-ignition is not received during the first cylinder reactivation, enriching the reactivated cylinder before receiving an indication of cylinder pre-ignition with a lower degree of richness than the first enrichment.

18. A method for an engine, comprising:

in response to a higher than threshold torque demand received while operating with boost enabled and one or more cylinders deactivated, reactivating the one or more cylinders while maintaining boost; and enriching the reactivated cylinders for a duration of the reactivation before receiving an indication of pre-ignition, the enriching based on each of the torque demand, engine boost level, and a preceding duration of cylinder deactivation.

19. The method of claim 18, wherein the one or more deactivated cylinders are coupled to a first engine bank, the engine further including a second engine bank, wherein during the reactivation, combustion at cylinders of the second engine bank is maintained at stoichiometry.

20. The method of claim 18, further comprising, increasing boost responsive to the higher than threshold torque demand after reactivating the one or more cylinders, and in response to the higher than threshold torque demand received while operating with boost disabled and the one or more cylinders deactivated, reactivating the one or more cylinders while maintaining boost disabled and while further maintaining cylinder combustion at stoichiometry until an indication of pre-ignition is received.

* * * * *